United States Patent [19]

Kugler

[11] Patent Number: 4,462,886

[45] Date of Patent: Jul. 31, 1984

[54] CATHODE FOR A FUSED SALT ELECTROLYTIC CELL

[75] Inventor: Tibor Kugler, Thayngen, Switzerland

[73] Assignee: Swiss Aluminium Ltd., Chippis, Switzerland

[21] Appl. No.: 435,046

[22] Filed: Oct. 18, 1982

[30] Foreign Application Priority Data

Oct. 23, 1981 [CH] Switzerland ..... 6788/81

[51] Int. Cl.[3] ..... C25C 3/08

[52] U.S. Cl. ..... 204/284; 204/286; 204/291; 204/293; 204/243 R

[58] Field of Search ..... 204/67, 243 R-247, 204/291, 293, 284, 286

[56] References Cited

U.S. PATENT DOCUMENTS 2,959,533 11/1960 De Varda ..... 204/67 X
3,459,515 8/1969 Bergmann ..... 204/291 X
3,471,380 10/1969 Bullough ..... 204/294 X
3,661,736 5/1972 Holliday ..... 204/67
4,339,316 7/1982 Peterson et al. ..... 204/67 X

*Primary Examiner*—Donald R. Valentine
*Attorney, Agent, or Firm*—Bachman and LaPointe

[57] ABSTRACT

The solid cathode comprises essentially a supporting element and, at least in the region of the cathode workface, an open-pore structure which is impregnated with or soaked in aluminum saturated with at least one of the transition metals from groups IV B, V B, and VI B of the periodic table of elements, This open-pore structure can be fed continuously from reserves of aluminide/aluminides. An open-pore structure which has shown itself to be particularly advantageous is one comprised of a carbon fiber felt pad a few millimeters thick. The solid cathodes are economical and can be made from material which is readily made into a variety of shapes.

16 Claims, 4 Drawing Figures

CATHODE FOR A FUSED SALT ELECTROLYTIC CELL

BACKGROUND OF THE INVENTION

The present invention relates to a wettable solid cathode having an aluminide of at least one transition metal from groups IV B, V B and VI B of the periodic system and intended for use in a fused salt electrolytic cell to produce aluminum.

The production of aluminum by electrolysis of aluminum oxide involves dissolving the latter in a fluoride melt which is made up for the greater part of cryolite. The aluminum, which precipitates out at the cathode, collects under the fluoride melt on the carbon floor of the cell, the surface of the liquid aluminum itself forming the cathode. Suspended from the overhead anode beam and dipping into the melt are anodes which in conventional processes are made of amorphous carbon. Oxygen is formed at the carbon anodes as a result of the electrolytic decomposition of the aluminum oxide. This oxygen combines with the carbon of the anodes to form $CO_2$ and CO.

The electrolytic process takes place in general in the temperature range of about 940°-970° C. During the course of the process, the electrolyte becomes deplete in aluminum oxide. At a lower concentration of about 1 to 2 wt. % of aluminum oxide in the electrolyte the anode effect occurs whereby there is an increase in voltage from e.g. 4–4.5 V to 30 V and higher. Then at the latest the concentration of aluminum oxide in the melt must be raised by adding further aluminum oxide (alumina).

The use of solid, wettable cathodes in the electrolytic production of aluminum is already known. Suggested cathode materials are e.g. titanium diboride, titanium carbide, pyrolytic graphite, boron carbide and further substances including mixtures which can for example be sintered together.

Using wettable cathodes the normal interpolar distance can be reduced from about 5 cm to such a level as is permitted by other parameters such as the circulation of the electrolyte in the interpolar gap and the maintenance of the bath temperature. The smaller interpolar distance results in a significant reduction in energy consumption and also prevents the creation of irregularities in the thickness of the liquid aluminum layer.

In contrast to the wettable cathodes anchored firmly in the carbon floor of the cell the U.S. Pat. No. 4,243,502 reveals solid cathodes made of individually exchangeable elements each having at least one electrical current supply. In a further development according to the U.S. patent application Ser. No. 262,049, now U.S. Pat. No. 4,376,690, the exchangeable elements are made of two different parts which are rigidly connected by mechanical means and are resistant to thermal shock viz., an upper part projecting from the molten electrolyte into the precipitated aluminum, and a lower part situated only in the liquid aluminum. The upper part is made, at least in the region of the surface, exclusively of a material which is wet by aluminum, whereas the lower part or its coating is made of an insulating material which can withstand liquid aluminum.

The object of the U.S. patent application Ser. No. 317,189 now U.S. Pat. No. 4,410,412, is an exchangeable solid cathode which is made of an aluminide of at least one of the metals of the group of elements comprising titanium, zirconium, hafnium, vanadium, niobium, tantalum, chromium, molybdenum and tungsten, without employing metallic aluminum as a binder. The non-aluminum components of the aluminide belong therefore to group III B, IV B and/or VI B of the periodic table of elements.

The ability of the aluminides to withstand chemical and thermal effects permits them to be employed both in the molten electrolyte and in the molten aluminum, even though they exhibit limited solubility in the latter. This solubility, however, diminishes rapidly with decreasing temperature.

At the operating temperature of the reduction cell which is around 900°-1000° C. the solubility in liquid aluminum of a metallic component of the aluminide other than aluminum is approximately 1%. This means that the non-aluminum elements in the cathode are leached from it until the precipitated liquid aluminum is saturated with one or more of the transition metals in the aluminide.

The elements from the aluminides leached out during the reduction process are recovered from the precipitated metal by cooling this to about 700° C. The aluminide crystallizing out of the liquid metal can be recovered by conventional means, and can be employed again in the production of cathode elements. The result is a recirculation of material with relatively little loss.

It is an object of the present invention to develop a solid cathode based on aluminides and with a service life equal to the lifetime of one or more anodes and such that the production and handling costs for the said cathode are substantially lowered.

SUMMARY OF THE INVENTION

The foregoing object is achieved by way of the present invention wherein the solid cathode comprises essentially a supporting body and, at least in the region of the working face, an open-pore structure which is impregnated with aluminum saturated with transition metal/metals, and which can be continuously fed from a reserve of aluminide/aluminides.

The working face is that surface of the cathode which, when installed in the electrolytic cell, points in the direction of the anode and through which the electric current flows. At this work face the aluminum ions are reduced to elemental aluminum. The work-faces of the cathode are therefore usefully slightly inclined in order that the precipitated aluminum which forms on the wettable cathode can flow off it.

The work-faces of the corresponding anodes, which e.g. can be made of combustible carbon or non-combustible ceramic oxide, are likewise inclined. Here too this sloping work-face is of advantage as the oxygen or the $CO_2$ formed can escape easier from the molten electrolyte.

The open-pore structure is attached to or a component part of the supporting body. If this body is made of a material which does not conduct electricity, the open-pore structure impregnated with aluminum saturated with transition metal/metals must extend at least to the liquid metal when the cathode is in service, so that the electric current can flow through this impregnating alloy and, if desired, through the structure. The supporting body is made therefore, preferably at least in part, of a material which, at 900° to 1000° C., is a good electrical conductor and is resistant to the molten electrolyte. In this case the current can flow mainly through the supporting body. Apart from the electrical conductivity it is essential that the material of the supporting body is inexpensive and readily shaped. For this reason carbon is particularly suitable for the supporting body.

When any manipulation of the anode beam is taking place, especially when changing the anodes, the cathode is always exposed to the risk of mechanical damage. The solid cathodes are therefore preferably made of elements which stand on the floor of the cell and can be changed individually. This allows damaged elements to be changed quickly.

The risk of damage can be reduced considerably if the solid cathodes are in the form of elements floating in the electrolyte with a space between them. At a temperature of 900° to 1000° C. the density of the molten electrolyte is 2.1 g/cm$^3$, and that of the liquid aluminum 2.3 g/cm$^3$. The density of a floating cathode must lie between these two values.

If the density of the cathode material is too small, it is possible to embed in the cathode pieces of iron which, however, must be uniformly distributed and completely surrounded by cathode material. The weight of the pieces of iron to be used has to be calculated such that the apparent density of the whole solid cathode lies between 2.1 and 2.3 g/cm$^3$.

If on the other hand the density of the cathode material is too high, then sealed cavities are provided in the cathode material.

Solid cathodes of the correct density float like rafts in liquid aluminum and are maintained at the desired distance from each other and from the edge of the cell preferably by means of appropriately shaped spacers.

If the anodes are accidentally pressed down on such floating cathodes, then the latter can yield and so suffer no damage.

The open-pore structure must be sufficiently permeable for the aluminum saturated with transition metal/-metals; on the other hand this aluminum must not be able to flow out without meeting any resistance.

Depending on the material used for the open-pore structure or coating, an optimum solution taking into account capillary and surface forces has to be sought.

These requirements can be met using sintered, fine-grain granules, or preferably by means of a fibrous structure. This fibrous structure is preferably in the form of a felt or gauze. The fibers are some microns thick and are preferably made of carbon.

The continuous feeding of the open-pore structure impregnated with aluminum saturated with transition metal/metals, takes place, depending on the geometric shape of the solid cathode and the chemical composition of the aluminide used, from hollow spaces in the solid body projecting into the open-pore structure, or from another site on the open-pore structure where solid aluminide can be secured.

For economic reasons and as a result of good scientific research titanium aluminides are preferred. Depending on the percentage of titanium in the aluminide, these aluminides are in different states at the 900°-1000° C. prevailing during electrolysis:

Aluminides containing less than 37.2 wt. % titanium are viscous-to-doughy at the cell operating temperature. These can not be employed as solid bodies, but only as a pourable cathode mass in spaces in the solid body.

Aluminides containing more than 37.2 (to 63) wt. % titanium on the other hand can also be combined with the open-pore structure as solid, shaped bodies.

The aluminum produced during the electrolysis process flows along the inclined open-pore structure, mixes with the aluminum saturated with transition metal/metals impregnating that open-pore structure, and would gradually reduce the concentration of transition metal to such an extent that the open-pore structure would be attacked and gradually dissolve. This is prevented, however, by arranging for the open-pore structure to be fed continuously from the aluminide reserves. The transition metal removed from the saturated aluminum is continuously replaced so that the open-pore structure remains impregnated with aluminum saturated with transition metal/metals.

With the preferred titanium aluminide the open-pore structure, in particular a 1-5 mm thick pad of carbon fibers, is coated with a thin, strongly adherent layer of titanium carbide or titanium boride. The, preferably thinner than 0.4 μm thick, layers are produced for example by chemical vapor deposition. If the aluminum impregnating the pad is always supersaturated with titanium, the wettable coating is not dissolved, as a result of which the lifetime of the pad can be increased many times.

An advantage of a pad made of coated carbon fibers is that, if the coating is imperfect, only individual fibers will be prematurely dissolved and not the whole working face of the pad.

The main advantage of the invention is therefore that using simple means, expensive ceramic solid bodies can be replaced by such made from inexpensive, readily shaped material with an open-pore surface structure impregnated with aluminum saturated with transition metal/metals.

The solid cathodes are particularly suitable also for retrofitting existing aluminum fused salt reduction cells.

BRIEF DESCRIPTION OF THE DRAWINGS

The invention is explained in greater detail with the help of drawings illustrating exemplified embodiments thereof. These show schematically sections through parts of electrolytic reduction cells wherein.

DETAILED DESCRIPTION

Figure 1:
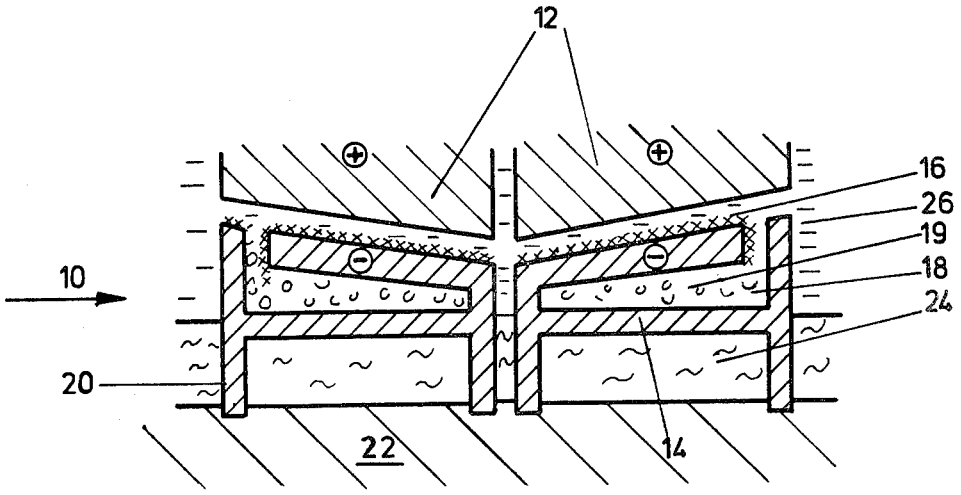
FIG. 1: Is a solid cathode with conductive supporting body and appropriately shaped anode.

In the version shown in FIG. 1 solid cathodes 10 and anode blocks 12 arranged in pairs form the electrode units of the reduction cell. The solid cathode 10 is made up of a shaped supporting element 14 made of carbon and, on the work-face directed towards the anode 12, a felt-like pad 16 made of carbon fibers coated with titanium carbide. Flaps on this approximately 4 mm thick pad 16 extend into a space 18 in the supporting element 14 which is filled with a titanium aluminide 19 which is in a doughy state at the operating temperature of the cell and is made e.g. of 80 wt. % aluminum and 20 wt. % titanium.

The feet 20 of the supporting element 14 stand in appropriately shaped recesses in the carbon floor 22 of the cell. The density of the solid cathode 10 must therefore be greater than that of the liquid aluminum 24.

During the reduction process, aluminum is precipitated on the pad 16 impregnated with titanium-saturated aluminum constituting the cathode. The precipitated aluminum mixes with the titanium-saturated aluminum in the pad and flows, in accordance with the slope on the work-face of the cathode, towards the middle of the electrode element. The pad 16 behaves like a wick in oil, and molten alloy is drawn out of the space 18 containing doughy titanium aluminide thus continuously replacing titanium lost from the pad. Without this replacement of the titanium the precipitated aluminum would dissolve away the titanium carbide coating on the carbon fibers and destroy the wettability of the cathode surface.

Due to the relatively small opening leading to space 18 only little of the circulating molten electrolyte 26 can enter that space; the transfer of material via convection is therefore small.

Figure 2:
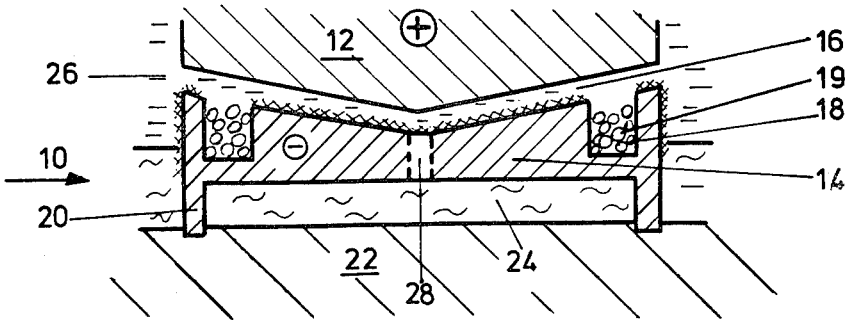
FIG. 2: Is a solid cathode with supporting body of electrically insulating material and appropriately shaped anode.

In FIG. 2 a solid cathode 10 and an anode block 12 form an electrode pair. The supporting element 14 is made of an insulating material, for example highly sintered aluminum oxide, ceramics containing aluminum oxide, silicon carbide or silicon nitride bonded silicon carbide. In order that the flow of the direct electric current can take place, the pad 16 covers as much as possible of the supporting element sidewalls, down into the molten aluminum 24. Space 18 is trough-shaped, features a relatively large opening, and is filled with solid titanium aluminide granules made for example of 55 wt. % aluminum and 45 wt. % titanium.

The pad 16 on the other hand does not extend down into space 18; the saturation of the aluminum in the pad 16 with titanium takes place by convection of the molten electrolyte.

The precipitated aluminum flows off through an opening 28 in the supporting element 14.

Figure 3:
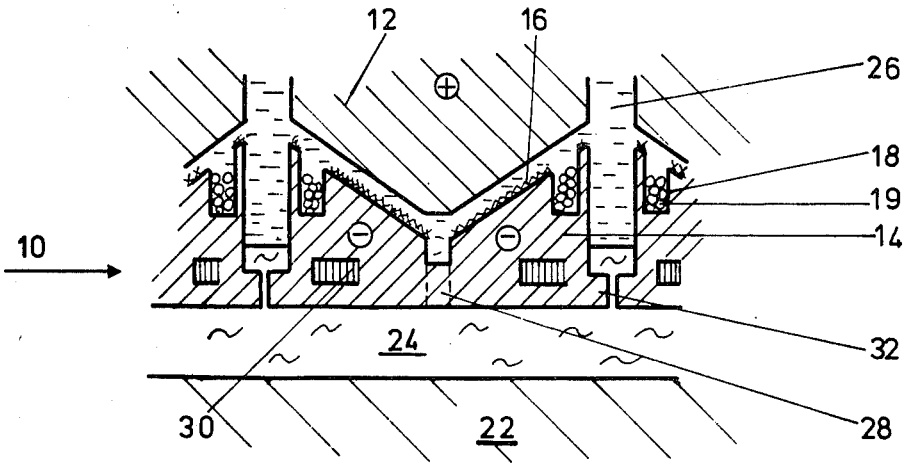
FIG. 3: Are solid cathodes, which float in molten aluminum, made of electrically conductive material, and appropriately shaped anodes.

The floating solid cathodes 10 shown in FIG. 3, aligned with the anodes 12, fill the whole pot in that their surrounding spacers 32 lie flush with each other. The apparent density of the whole solid cathode at the operating temperature must lie between the density of the molten electrolyte and that of the molten aluminum. This is achieved with supporting elements made of carbon by inserting pieces of iron 30 in closed spaces, for example in the form of a ring.

Figure 4:
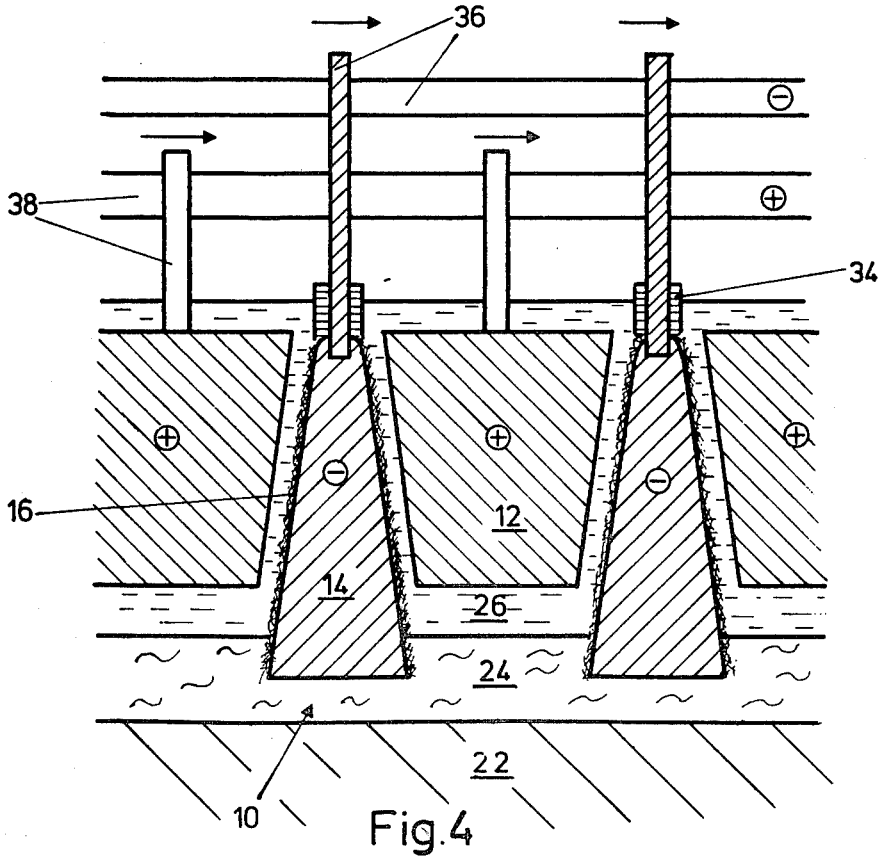
FIG. 4: Are solid cathodes made of electrically conductive material and appropriately shaped anodes arranged alternatingly.

In FIG. 4 solid cathodes 10 suspended from an overhead cathode support system 36 and anodes 12 suspended from an anodic support system 38 are arranged alternatingly. The feeding of the "felt" pad 16 takes place via sleeves 34 of solid aluminide mounted on the rod carrying the supporting element.

If the anodes 12 are of carbon and therefore burn off, the cathodes and anodes can be moved to the right in the direction of the arrows. A generally known mechanism ensures that, after this displacement, the same interpolar distance is achieved between anode and cathode.

Consequently, the anodes 12 and cathodes 14 at the left have to be displaced farther than those on the right. Consumed anodes are removed, along with the cathodes, on the right.

This produces an adequate space on the left hand side for the cathodes to be put back into service along with new anodes.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A wettable solid cathode for use in an aluminum fused salt reduction cell comprising a supporting element having an open-pore porous work-face, said open-pore porous work-face being continuously impregnated with an aluminide from a reservoir, said aluminide comprising aluminum saturated with a metal selected from the group consisting essentially of groups IV B, V B and VI B of the periodic table.

2. A cathode according to claim 1 wherein the cathode is in the form of an exchangeable element.

3. A cathode according to claim 1 wherein said supporting element is made at least in part of a material characterized by good electrical conductivity at 900°-1000° C. and resistance to the molten electrolyte.

4. A cathode according to claim 3 wherein said supporting element is made at least in part of carbon.

5. A cathode according to claim 1 wherein said supporting element has at least one space to accommodate the aluminide, into which space the open-pore structure projects.

6. A cathode according to claim 1 wherein said porous work-face is made up of sintered, fine-grained particles.

7. A cathode according to claim 1 wherein said porous work-face is made up of fibers, preferably in the form of felt or gauze.

8. A cathode according to claim 7 wherein said porous work-face is made up of a felt pad of carbon fibers.

9. A cathode according to claim 8 wherein said felt pad is about 1-5 mm thick.

10. A cathode according to claim 1 wherein titanium aluminide is employed and said porous work-face is coated with titanium carbide to a thickness of about 0.4 μm.

11. a cathode according to claim 1 wherein titanium aluminide is employed and said porous work-face is coated with titanium diboride to a thickness of about 0.4 μm.

12. A cathode according to claim 1 wherein the cathode is characterized by an apparent density at 900°-1000° C. which lies between that of the electrolyte and that of the liquid aluminum.

13. A cathode according to claim 12 wherein the cathode is characterized by an apparent density at 900°-1000° C. of between about 2.1 and 2.3 g/cm$^3$.

14. A cathode according to claim 12 wherein uniformly distributed pieces of iron surrounded by cathode material are employed to achieve the correct apparent density.

15. A cathode according to claim 1 wherein the reservoir of aluminide is located in said supporting element.

16. A cathode according to claim 1 wherein the reservoir of aluminide is located on a rod supporting said cathode.

* * * * *